US006695228B2

(12) United States Patent
Odessa

(10) Patent No.: US 6,695,228 B2
(45) Date of Patent: Feb. 24, 2004

(54) SELF-PRESSURIZING SPRAYER

(75) Inventor: Ronald M. Odessa, Batavia, NY (US)

(73) Assignee: Chapin Manufacturing, Inc., Batavia, NY (US)

( * ) Notice: Subject to any disclaimer, the term of this patent is extended or adjusted under 35 U.S.C. 154(b) by 272 days.

(21) Appl. No.: 09/934,747

(22) Filed: Aug. 22, 2001

(65) Prior Publication Data

US 2002/0023974 A1 Feb. 28, 2002

Related U.S. Application Data

(60) Provisional application No. 60/226,831, filed on Aug. 22, 2000.

(51) Int. Cl.[7] ..... B05B 7/32

(52) U.S. Cl. ..... 239/337; 239/302; 239/333; 239/338; 239/373

(58) Field of Search ..... 239/302, 310, 239/315, 318, 320, 321, 322, 329, 330, 331, 333, 337, 338, 340, 349, 352, 355, 360, 361, 367, 373; 137/209, 211.5; 222/401, 402; 141/18, 21, 67

(56) References Cited

U.S. PATENT DOCUMENTS

| | | | | | |
|---|---|---|---|---|---|
| 194,597 | A | | 8/1877 | Hearle | |
| 1,078,028 | A | | 11/1913 | Zeamans | |
| 1,246,227 | A | | 11/1917 | Bouvin | |
| 1,299,567 | A | | 4/1919 | Farr | |
| 1,499,642 | A | * | 7/1924 | Craig | 222/402 |
| 1,616,775 | A | | 2/1927 | Williams | |
| 2,501,260 | A | | 3/1950 | Brodin | |
| 2,645,381 | A | | 7/1953 | Lattman | |
| 2,750,752 | A | | 6/1956 | Yorgey, Jr. | |
| 2,813,402 | A | | 11/1957 | Poethig et al. | |
| 2,917,077 | A | | 12/1959 | Ziege | |
| 2,968,315 | A | | 1/1961 | Fisher | |
| 3,103,950 | A | | 9/1963 | Gulick | |
| 3,109,566 | A | | 11/1963 | Yetter | |
| 3,211,173 | A | | 10/1965 | Mueller et al. | |
| 3,245,583 | A | | 4/1966 | Miller et al. | |
| 3,718,165 | A | | 2/1973 | Grothoff | |
| 3,735,777 | A | | 5/1973 | Katzer et al. | |
| 3,749,141 | A | | 7/1973 | Garretson | |
| 3,756,513 | A | * | 9/1973 | Denninger | 239/337 |
| 3,782,640 | A | | 1/1974 | Kirschmann | |
| 3,790,039 | A | | 2/1974 | Zucconi | |
| 3,794,077 | A | | 2/1974 | Fanshier | |
| 3,918,481 | A | | 11/1975 | Doe et al. | |
| 3,993,245 | A | * | 11/1976 | Smith | 239/373 |
| 4,154,367 | A | | 5/1979 | Hanson et al. | |
| 4,180,189 | A | | 12/1979 | Zurit et al. | |
| 4,186,783 | A | | 2/1980 | Brandt | |
| 4,244,526 | A | | 1/1981 | Arth | |
| 4,319,604 | A | | 3/1982 | Bird | |
| 4,431,117 | A | | 2/1984 | Genbauffe et al. | |
| 4,436,111 | A | | 3/1984 | Gold et al. | |
| 4,682,625 | A | | 7/1987 | Christopher | |
| 4,782,982 | A | | 11/1988 | Ellison | |
| 4,930,664 | A | | 6/1990 | Ellison | |
| 4,930,686 | A | | 6/1990 | Ellison | |
| 5,174,343 | A | * | 12/1992 | Rood | 141/18 |
| 5,373,975 | A | * | 12/1994 | Husted | 222/402.1 |
| 6,234,347 | B1 | * | 5/2001 | Amron | 222/401 |
| 6,394,148 | B1 | * | 5/2002 | Clarke | 141/18 |

* cited by examiner

*Primary Examiner*—Robin O. Evans
(74) *Attorney, Agent, or Firm*—Jaeckle Fleischmann & Mugel, LLP

(57) ABSTRACT

The invention provides self-pressurizing sprayer assembly 10 with a single external bulkhead fitting 40. The invention includes hose 14 connected to bulkhead fitting 40 and T-type connector 16 connected to the other end of hose 14. T-type connector 16 couples hose 14 to hand operated discharge control valve 20 and quick-disconnect fitting 18. Alternatively, hose 114 is fitted with a female quick-disconnect connector and connects directly to discharge control valve 116 or quick-disconnect fitting 18. Quick-disconnect fitting 18 couples hose 14 or hose 114 to a source of domestic water supply, such as garden hose 89.

5 Claims, 2 Drawing Sheets

SELF-PRESSURIZING SPRAYER

CROSS-REFERENCE TO RELATED APPLICATIONS

This application claims the benefit of U.S. Provisional Patent Application Serial No. 60/226,831, filed Aug. 22, 2000.

TECHNICAL FIELD

The present invention relates to a pump sprayer assembly for spraying liquids or fluid. More particularly, the present invention relates to a pump sprayer where the pressure in the sprayer may be supplied or increased with a conventional domestic water supply.

BACKGROUND OF THE INVENTION

Pump sprayers are typically used for dispensing fluids such as cleaning fluids, insecticides, herbicides, fertilizers and other materials. Conventional pump sprayers include a supply tank or reservoir dimensioned to hold a volume of liquid, a manual pump or piston, a pressure vessel or accumulator, a bulkhead discharge fitting, a discharge valve, and a spray wand with a discharge control valve and nozzle from which the fluid is discharged. In some conventional pump sprayers, the reservoir supply tank performs its intended function and also serves the function of the accumulator or pressure vessel. In operation, the reservoir initially contains air at atmospheric pressure and the fluid to be sprayed. The operation of the pump forces air into the reservoir, thereby increasing the pressure of the air therein. The compressed air, in turn, exerts pressure on the fluid contained in the reservoir. Operation of the discharge control valve allows the pressure within the accumulator to push the fluid out through the nozzle until the valve is closed or equilibrium is reached. Others have attempted to improve upon the conventional design of the sprayer by providing a reservoir that is equipped to receive an auxiliary air charge. These changes in the basic design are called self-pressurizing sprayers and examples are found in U.S. Pat. Nos. 4,782,982, 4,930,686, and 4,930,664. In those modified designs, the reservoirs or containers have a second, separate bulkhead fitting or nipple that may be rapidly connected and disconnected to a domestic water supply. In a typical manner, the domestic water supply is a garden hose. By attaching the garden hose to the bulkhead fill fitting, the user introduces water into the reservoir and since the reservoir is sealed, compresses the air in the reservoir to provide the sprayer with an initial charge. The initial charge of air is accomplished without operating the manual pump.

Conventional self-pressurizing sprayers have one or more deficiencies. All are confronted with the problem of potential backflow into the domestic water supply. If the pressure in the sprayer is greater than the water supply pressure, it is possible that fluid in the sprayer could be forced into the domestic water supply. This would create an unsatisfactory condition where, for example, insecticide might be pumped into the water supply of a home owner. It is conceivable that if there was a sudden decrease in the domestic water supply pressure, pressurized fluid from the sprayer could be forced through the garden hose and into the domestic water supply. Then, when the user turned on a faucet, his domestic water supply would be contaminated with insecticides or other contaminants.

Another drawback of conventional self-pressurizing sprayers is that the spray container itself is modified to have two external bulkhead fittings. One fitting connects to the conventional discharge tube. The second fitting connects to the domestic water supply. By providing a second fitting on the container, new molds must be formulated for the container. The second bulkhead fitting increases the overall expense of the sprayer by requiring a new mold for the self-pressurizing container. In addition, distribution costs for sprayers are adversely affected. A distributor has to carry the conventional, single bulkhead fitting sprayers, as well as the dual bulkhead fitting sprayers. As a result, the overall cost of sprayers, including their distribution cost, is increased.

SUMMARY OF THE INVENTION

The invention provides a self-pressurizing sprayer with a single external bulkhead fitting. The invention modifies the discharge tube to have a T-type or an in-line fitting. The T-type or in-line quick-disconnect fitting couples the discharge tube to a source of domestic water supply, such as a garden hose. Once connected, the garden hose supplies water under pressure to the sealed sprayer reservoir. The water is supplied via the discharge hose and travels through the discharge tube toward the bottom of the reservoir. In the event that solid materials are disposed in the sprayer reservoir, the water from the discharge tube agitates those materials at the bottom of the sprayer container and assists in mixing those materials while the sprayer is filling.

BRIEF DESCRIPTION OF THE DRAWINGS

The above-mentioned and other features and advantages of this invention, and the manner of attaining them, will become apparent and be better understood by reference to the following description of one embodiment of the invention in conjunction with the accompanying drawings, wherein.

Corresponding reference characters indicate corresponding parts throughout the several views. The exemplifications set out herein illustrate the preferred embodiments of the invention and such exemplifications are not to be construed as limiting the scope of the invention in any manner.

DESCRIPTION OF THE PREFERRED EMBODIMENTS

Figure 1:
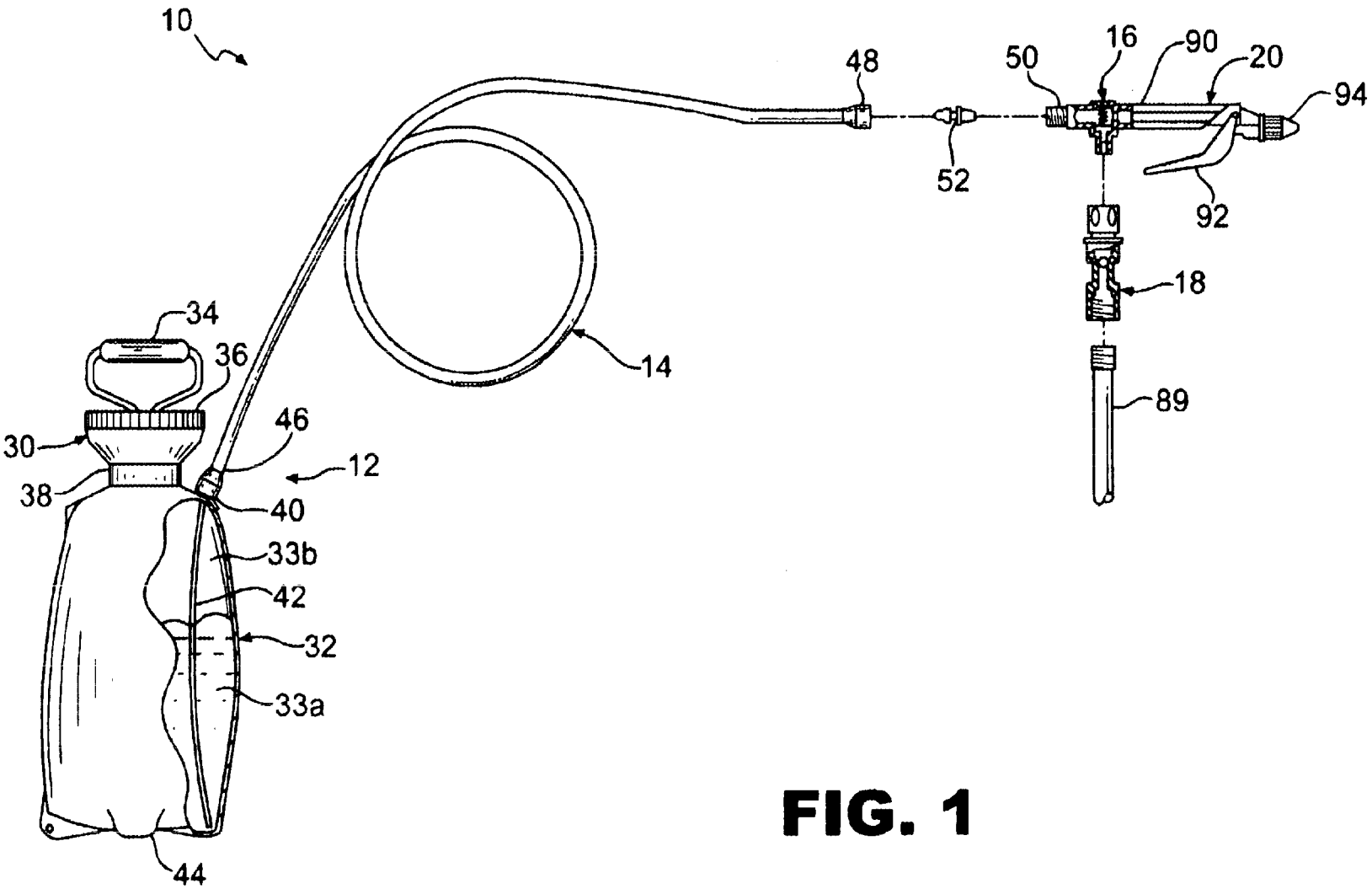
FIG. 1 is a partial sectional view of one embodiment of a self-pressurizing sprayer of the present invention.

Referring now to the drawings and particularly to FIG. 1, there is shown a self-pressurizing sprayer assembly of the present invention. Sprayer assembly 10 includes pressure vessel 12, hose 14, T-type connector 16, quick-disconnect fitting 18, and discharge control valve 20.

Pressure vessel 12 is formed of a rigid material such as, for example molded plastic or stainless steal and includes top portion 30, container portion 32, material 33*a*, and pressure head 33*b*. Top portion 30 includes hand pump 34, threaded cover 36, and hollow neck 38. Neck 38 is integral with or affixed to container portion 32 in a substantially air-sealed manner and is threaded for a substantially air-sealed engagement with threaded cover 36. Hand pump 34 is integral with or affixed to threaded cover 36 and extends through neck 38 into container portion 32. Container portion 32 includes bulkhead fitting or nipple 40, hollow tube 42, and feet 44. Nipple 40 is disposed on top of container portion 32 and is threaded. Hollow tube 42 extends from nipple 40 to the bottom of container portion 32. Feet 44 are affixed to or integral with the bottom of container portion 32 to add stability to sprayer assembly 10. Material 33*a* is the material to be sprayed and is typically an herbicide, insecticide, or fertilizer. Material 33*a* partially fills container portion 32 as shown in FIG. 1, leaving pressure head 33*b*. Pressure head 33*b* consists of a volume of air.

Hose 14 is a flexible tube for communicating fluid between pressure vessel 12 and T-type connector 16 and includes first end 46 and second end 48. First end 46 of hose 14 is threaded for a substantially air-sealed engagement with nipple 40. Second end 48 of hose 14 is threaded for a substantially air-sealed engagement with T-type connector 16.

Figure 2:
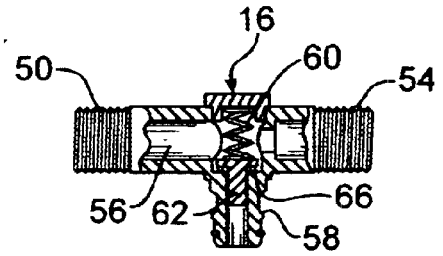
FIG. 2 is a magnified view of the T-type connector between the hose and the discharge valve of FIG. 1.

Referring now to FIG. 2, T-type connector 16 includes first coupling 50, bulkhead insert 52, second coupling 54, central chamber 56, branch member 58, spring 60, and valve element 62. First coupling 50 is threaded for substantially air-sealed engagement with second end 48 of hose 14. Bulkhead insert 52 is disposed within the coupled first coupling 50 and second end 48. Second coupling 54 is threaded for a substantially air-sealed engagement with the threaded end of manually operated discharge control valve 20. Central chamber 56 is a hollow chamber that extends from first coupling 50 to second coupling 54. Branch member 58 is a hollow cylinder and is integral with central chamber 56. Spring 60 biases valve element 62 against branch member seat 66.

Figure 3:
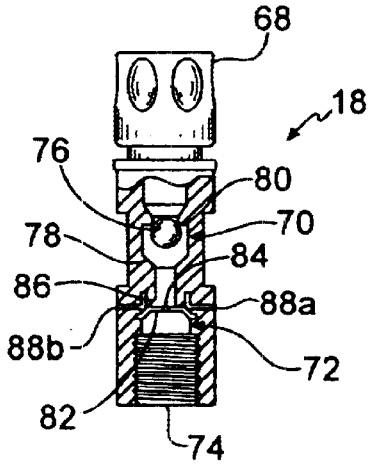
FIG. 3 is a sectional view of a quick-disconnect fitting in the forward flow condition.
Figure 4:
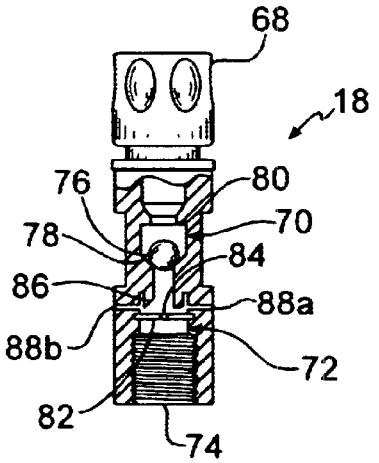
FIG. 4 is a sectional view of a quick-disconnect fitting in the reverse flow condition.

Quick-disconnect fitting 18 is best shown in FIGS. 3 and 4. Quick-disconnect fitting 18 includes connector 68, check valve 70, diaphragm valve 72, and garden hose coupling 74. Connector 68 is configured as a quick-disconnect coupling device and engages branch member 58 in a substantially air-sealed manner. Check valve 70 includes check ball 76, check valve seat 78 and check ball retainer 80. FIG. 3 shows check valve 70 in the open state in which check ball 76 engages check ball retainer 80. FIG. 4 shows check valve 70 in the closed state in which check ball 76 engages check valve seat 78. Diaphragm valve 72 includes diaphragm 82, diaphragm hole 84, diaphragm valve seat 86, and vent holes 88*a*, 88*b*. FIG. 3 shows diaphragm valve 72 in the closed state in which diaphragm 82 is forced into a substantially air-sealed engagement with diaphragm valve seat 86, thus sealing off vent holes 88*a*, 88*b*. FIG. 4 shows diaphragm valve 72 in the open state in which diaphragm 82 is in a relaxed or unstretched position and vent holes 88*a*, 88*b* vent diaphragm valve 72 to the atmosphere. Garden hose coupling 74 is threaded for a substantially water-sealed engagement with standard garden hose 89, which, in turn connects to a domestic or other water supply.

Discharge control valve 20 includes threaded end 90, hand trigger 92, and nozzle 94. Hand trigger 92 operably opens and closes discharge control valve 20. Nozzle 94 directs material 33*a* such as, for example into a spray or a narrow stream.

In use, sprayer assembly 10 is loaded with 33*a* and is charged with air by hand pump 34 or water by standard garden hose 89 via quick-disconnect fitting 18, T-type connector 16, hose 14, nipple 40, and tube 42. The charged air or water the air in pressure vessel 12 increases pressure head 33*b*. Thus, as hand trigger 92 is pulled, opening discharge control valve 20, pressure head 33*b* within pressure vessel 12 forces material 33*a* in the bottom of container portion 32 through tube 42, nipple 40, hose 14, T-type connector 16, and shut-off valve 64. More particularly, hand pump 34 and threaded cover 36 are removed from neck 38 and material 33*a* partially fills container portion 32 via neck 38. Hand pump 34 and threaded cover 36 are threaded back onto neck 38, forming a substantially air-tight seal. Hand pump 34 is operated to charge pressure vessel 12 with air, thus increasing pressure head 33*b*. After a sufficient pressure is reached, discharge control valve 20 is opened by hand operation of hand trigger 92. The pressure on material 33*a* due to pressure head 33*b* forces material 33*a* into tube 42. Material 33*a* travels through tube 42, nipple 40, hose 14, and T-type connector 16 into shut-off valve 64 and out nozzle 94. As material 33*a* is discharged from sprayer assembly 10, the pressure of pressure head 33*b* decreases. Hand pump 34 is operated to maintain or increase pressure head 33*b* while discharge control valve 20 is open or closed.

Alternatively, garden hose 89 is threaded to quick-disconnect fitting 18 which, in turn, is connected to branch member 58 of T-type connector 16. Water flows from water supply, through garden hose 89, and into diaphragm valve 72. As best shown in FIG. 3, the water pressure urges diaphragm 82 against diaphragm valve seat 86, thereby closing vent holes 88*a*, 88*b*. The water flows through diaphragm hole 84 into check valve 70. The water pressure forces check ball 76 against check valve seat 78 which, restrains check ball 76 while the water flows by into branch member 58. The water pressure forces valve element 62 against spring 60, thereby opening the valve. The water flows into central chamber 56, then through hose 14, nipple 40, tube 42, and into the bottom of container portion 32. As the water flows into container portion 32, it agitates and mixes material 33*a* and decreases the volume available to pressure head 33*b*, thereby increasing the pressure of pressure head 33*b*. After a sufficient pressure is reached, quick-disconnect fitting 18 is removed from T-type connector 16 and discharge control valve 20 is opened by hand operation. Material 33*a* is discharged from sprayer assembly 10 as described above. Hand pump 34 is operated to maintain or increase pressure head 33*b* while shut-off valve is open or closed.

Referring now to FIG. 4, in the event that the pressure in pressure vessel 12 and thus, hose 14 and T-type connector 16 is greater than the pressure of the water supply, backflow of material 33*a* into the water supply is substantially prevented by check valve 70. More particularly, a pressure in T-type connector 16 that is greater than the water pressure urges check ball 76 against check valve seat 78, closing check valve 70 and thereby preventing substantial backflow of material 33*a*. As water pressure equalizes on both sides of diaphragm 82, diaphragm 82 relaxes as shown in FIG. 4. Thus, vent holes 83*a*, 88*b* are now open to diaphragm valve 72 and the water flows from diaphragm valve 72 into the atmosphere. Therefore, the water pressure does not build up in diaphragm valve 72 and substantially guarantees that check ball 76 positively sits on check valve seat 78 during backflow, thereby substantially preventing contamination of the water supply by material 33*a*.

Figure 5:
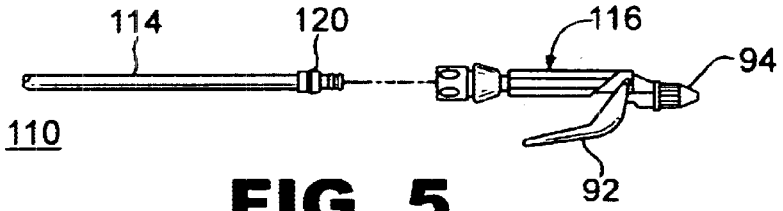
FIG. 5 is a side view of a second embodiment of the hose and discharge valve of the present invention.

Referring now to FIG. 5, a second embodiment of a self-pressurizing sprayer assembly of the present invention is shown. The same reference numbers are used to indicate component parts associated with sprayer assembly 110 that are substantially identical in structure and function as those of sprayer assembly 10, described above. Sprayer assembly 110 includes pressure vessel 12, quick-disconnect fitting 18, hose 114, and discharge control valve 116.

Hose 114 includes first end 118 and second end 120. First end 118 of hose 114 is threaded for a substantially air-sealed engagement with nipple 40. Second end 120 terminates hose 114 with a female quick-disconnect fitting for a substantially air-sealed engagement with quick-disconnect fitting 18. Second end 120 also includes spring-loaded valve 122 (not shown) that is normally closed. Spring-loaded valve 122 opens as a male quick-disconnect fitting is attached to second end 120.

Discharge control valve 116 includes a male quick-disconnect fitting for a substantially air-sealed engagement with second end 120 of hose 114, hand trigger 92, and nozzle 94.

In use, shut-off valve 116 is attached to second end 120 of hose 114, thereby opening spring-loaded valve 122. Pressure vessel 12 is charged with air by operation of hand pump 34 to increase pressure head 33*b* as described above. Material 33*a* is discharged from sprayer assembly 110 by hand operation of discharge control valve 116 as described for sprayer assembly 10 above.

Alternatively, garden hose 89 is threaded into quick-disconnect fitting 18 which, in turn, is connected to second end 120 of hose 114, thereby opening spring-loaded valve 122. Water from the water supply flows through garden hose 89 and quick-disconnect fitting 18 as described above. The water flows from quick-disconnect fitting 18 directly into hose 114, then through nipple 40 and tube 42. The water mixes with material 33*a* and increases pressure head 33*b* as described above. Backflow of material 33*a* into the water supply is substantially prevented by quick-disconnect fitting 18 as described above. After sufficient pressure is reached, quick-disconnect fitting is removed from second end 120 of hose 114 and shut-off valve 116 is connected to second end 120 of hose 114. Material 33*a* is then discharged from sprayer assembly 110 by hand operation of shut-off valve 116 as described for sprayer assembly 10 above.

In the embodiments shown, the couplings between nipple 40 and first end 46 of hose 14 and T-type connector 16 and second end 48 of hose 14 in the first embodiment and the coupling between nipple 40 and first end 118 of hose 114 in the second embodiment are described as threaded connections. However, it should be understood that the present invention can be alternately configured such as, for example with barb connections or any other suitable means for forming a substantially air-tight seal.

It should be particularly noted that as the water flows through tube 42 into container portion 32, it enters container portion 32 proximate the bottom. Thus, the water effectively agitates and mixes material 33*a*. This is especially desirable when material 33*a* includes solid particles.

Having thus described the embodiments of the invention, those skilled in the art will appreciate that further modifications, changes, omissions and variations can be made to those embodiments without departing from the spirit and scope of the invention as set forth in the following claims.

What is claimed is:

1. A self-pressurizing sprayer comprising:

a pressure vessel comprising a walled container with a sealable opening at one end for holding a discharge fluid and sealable to hold a pressure head above a discharge fluid;

a manual pump for applying a head of pressure to a volume of air above the fluid;

a bulkhead fitting on the pressure vessel and defining an opening in the in the wall of the pressure vessel for the entrance and exit of fluid;

a tube extending from proximate the bottom of the pressure vessel to the interior end of the bulkhead fitting;

a hose coupled at one end to the exterior end of the bulkhead fitting;

a discharge control valve; and a tee fitting connected to the other end of the discharge hose, said tee fitting having first and second inlet openings and an outlet opening, the outlet opening coupled to the discharge control valve, the first inlet opening connected to the hose and the second inlet opening selectively connected to a source of pressurized fluid whereby pressurized fluid coupled to the tee fitting fills the pressure vessel until the pressure head in the vessel equals the pressure of the fluid connected to the tee fitting.

2. The self-pressurizing sprayer of claim 1 wherein the tee fitting comprises a body with first and second fluid passages where the first fluid passage is intersected by the second fluid passage and a normally closed valve is disposed at the intersection of the fluid passages to normally close a path between the first and the second passage and to open said path when the fluid pressure in the second passage is applied to the normally closed valve.

3. The self-pressurizing sprayer of claim 1 further comprising a quick disconnect fitting coupled to the second inlet opening of the tee fitting.

4. The self-pressurizing sprayer of claim 3 wherein the quick disconnect fitting comprises:

an elongated body with a central fluid chamber extending between a first end connected to the second inlet and a second end connectable to the source of pressurized fluid;

a check valve seat at the second end of the elongated body;

a moveable check valve element for seating on the valve seat when the pressure at the first end is greater than the pressure at the second end;

a diaphragm valve seat in fluid communication with the check valve seat and spaced therefrom in a direction toward the source of fluid pressure;

a resilient diaphragm member for sealing against the diaphragm valve seat;

a diaphragm chamber disposed around the diaphragm valve seat; and one or more vents in the diaphragm chamber extending to atmosphere to vent the diaphragm chamber and prevent a pressure lock when the pressure in the pressure vessel exceeds the pressure of the fluid source.

5. A self-pressurizing sprayer comprising:

a pressure vessel comprising a walled container with a sealable opening at one end for holding a discharge fluid and sealable to hold a pressure head above a discharge fluid;

a manual pump for applying a head of pressure to a volume of air above the fluid;

a bulkhead fitting on the pressure vessel and defining an opening in the in the wall of the pressure vessel for the entrance and exit of fluid;

a tube extending from proximate the bottom of the pressure vessel to the interior end of the bulkhead fitting;

a hose coupled at one end to the exterior end of the bulkhead fitting;

a discharge control valve; and a disconnect fitting connected to the other end of the discharge hose and to the discharge control valve, said disconnect fitting having a check valve for preventing flow from the pressure vessel when the discharge control valve is removed and for receiving a mating fitting on an end of a garden hose to supply fluid to the pressure vessel or on the end of a discharge control valve to control flow from the pressure vessel.

* * * * *